United States Patent [19]

Zeiffer et al.

[11] Patent Number: 4,884,893

[45] Date of Patent: Dec. 5, 1989

[54] METHOD AND APPARATUS FOR GENERATING AND DISPERSING IMMISCIBLE LIQUID PARTICLES IN A CARRIER LIQUID AND DISPENSING SAID CARRIER LIQUID

[75] Inventors: Dieter F. Zeiffer, Iron Station, N.C.; George M. Junkins, Dalton, Ga.

[73] Assignee: Gaston County Dyeing Machine Co., Stanley, N.C.

[21] Appl. No.: 71,783

[22] Filed: Jul. 10, 1987

[51] Int. Cl.[4] ..... B01F 5/06

[52] U.S. Cl. ..... 366/176; 366/168; 366/171

[58] Field of Search ..... 366/150, 176, 155, 168, 366/171, 172, 154, 165, 167, 173, 174

[56] References Cited

U.S. PATENT DOCUMENTS

| | | | |
|---|---|---|---|
| 1,890,106 | 12/1932 | Bendixen . | |
| 2,758,481 | 8/1956 | Mouravieff . | |
| 3,252,689 | 5/1966 | Blomgren | 366/168 |
| 3,525,504 | 8/1970 | Colwell | 366/168 |
| 3,559,959 | 2/1971 | Davis . | |
| 3,688,530 | 9/1972 | Harris . | |
| 3,744,763 | 7/1973 | Schnoring . | |
| 3,881,704 | 5/1975 | Smith . | |
| 3,899,903 | 8/1975 | Lapierre . | |
| 3,937,044 | 2/1976 | Balmforth . | |
| 4,141,231 | 2/1979 | Kudlich . | |
| 4,264,322 | 4/1981 | Lewis . | |
| 4,267,712 | 5/1981 | Gruber . | |
| 4,275,683 | 6/1981 | Kutz . | |
| 4,369,640 | 1/1983 | Fox . | |
| 4,377,080 | 3/1983 | Fox . | |
| 4,403,360 | 9/1983 | Finney . | |
| 4,454,617 | 6/1984 | Moates . | |
| 4,463,467 | 8/1984 | Gruber . | |
| 4,505,713 | 3/1985 | Eichmanns . | |
| 4,547,921 | 10/1985 | Otting . | |

*Primary Examiner*—Robert W. Jenkins

*Attorney, Agent, or Firm*—Shefte, Pinckney & Sawyer

[57] ABSTRACT

A method and apparatus for generating and dispersing immiscible liquid particles in a carrier liquid by introducing the immiscible liquid as streams into a tubular flow of carrier liquid and shearing particles from the streams immediately as they enter the flow path with shearing elements rotating through the tubular flow path closely adjacent the ends of the tubes. The flow of the particle-containing liquid is stabilized by vanes extending parallel to the tubular flow path and the flow is disrupted to disturb any uneven concentration of particles by an offset portion of the flow conduit, which offset portion is rotated. The flow is distributed into dispensing conduits mounted on a support that is reciprocated to impart a primary reciprocal motion and a secondary reciprocal motion to the dispensing of the particle-containing carrier liquid for application to a substrate, such as carpet. The reciprocal motions are provided by an orbiting shaft having a sprocket fixed thereon and one end of a link connected thereto with the other end of the link connected to an eccentric shaft on the support to impart primary reciprocal motion and a sprocket carried on the eccentric shaft connected by a chain to the sprocket on the orbiting shaft imparts a lesser secondary reciprocal motion through the eccentric shaft to the support.

26 Claims, 7 Drawing Sheets

METHOD AND APPARATUS FOR GENERATING AND DISPERSING IMMISCIBLE LIQUID PARTICLES IN A CARRIER LIQUID AND DISPENSING SAID CARRIER LIQUID

BACKGROUND OF THE INVENTION

The present invention relates to a method and apparatus for generating and dispersing immiscible liquid particles in a carrier liquid and dispensing said carrier liquid, and more particularly to such a method and apparatus in which particles are sheared from a stream of an application liquid into a flow of a carrier liquid and combined with other particle-containing carrier liquids and then distributed through a distributor to dispensing conduits onto a substrate.

The present invention is especially applicable to dyeing of textiles, particularly carpets, to produce a randomly appearing speckled color effect by generating discrete particles of a dye liquid in a carrier liquid in which the particles are at least temporarily immiscible, then combining a plurality of such particle-containing carrier liquids and distributing the combined liquids through conduits from which the liquid is dispensed onto the textile or carpet substrate.

Prior known devices used for generally similar purposes utilize inline static mixers or shear blades rotating in chambers containing both carrier liquid and dye liquid. These devices produce somewhat separate particles, but not reliably finite discrete particles as the blending or mixing effect tends to form the particles with tails as one liquid trails into the other liquid. In addition, static mixers are particularly susceptible to particles adhering to the shearing elements, causing clogging and making it difficult to clean the mixer. Also, there is a problem of the possible establishment of flow patterns of particles and concentration of particles during the movement of particle-containing carrier liquid through conduits to the substrate, which patterns appear as undesirable effects in the finished product. Further, prior oscillating devices for moving the ends of the conduits to provide a random application and effect have not been totally satisfactory as the repeat of the dwell of the oscillation tends to establish undersirably discernible patterns and concentrations in the resulting product.

The present invention provides a method and apparatus that significantly improves the generation and dispersion of finite discrete particles of an application liquid in a carrier liquid in which the application liquid is at least temporarily immiscible without significant clogging or cleaning problems. It also provides for disruption of the flow of the particle-containing carrier liquid to avoid particle pattern or concentration effects in application, and provides an improved compound oscillation that avoids particle concentration and patterning during oscillation reversal by varying the location of the reversal.

SUMMARY OF THE INVENTION

Briefly described, the method of the present invention entails creating a flow of a carrier liquid, introducing into the flow a stream of another liquid that is at least temporarily immiscible in the carrier liquid while shearing the stream into discrete particles as it enters the flow to form a dispersion of the particles in the carrier liquid. The particle-containing carrier liquid is then distributed through a plurality of conduits from which the liquid is tubular with streams of the immiscible liquid being introduced parallel to the flow path and being sheared transverse to the flow path. The streams can be created by tubes and the shearing can be accomplished by shearing elements rotating at the ends of the tubes. The flow of the particle-containing carrier liquid may be disturbed prior to distributing so as to avoid the formation of continuous non-uniform patterns of flow of particles. This can be accomplished by directing the flow in an offset path and then rotating the offset path. The dispensing may include reciprocating the exit ends of the conduits in relation to the substrate with a primary reciprocal motion and a secondary reciprocal motion imposed on the primary motion. Preferably, a plurality of flows of carrier liquids containing different particles are combined into a common flow, which combining is preferably performed tangentially to the common flow path.

In the preferred embodiment, the method is used with carrier liquid that is a cationic clear gum material and the other liquid is an anionic dye gum material that is substantially immiscible in the cationic clear gum and thereby retains its discrete particle form when applied and cured on a textile or carpet substrate.

The apparatus of the present invention includes means for providing a supply of a carrier liquid, means for providing a supply of another liquid that is at least temporarily immiscible in the carrier liquid, and a housing adapted to receive liquid from the supplies. The housing has a passage for flow of the carrier liquid therethrough and an opening for introducing a stream of the other liquid into the passage. Shearing means is mounted in the housing and extends into the passage at the openings, for shearing the stream into discrete particles as the stream enters the passage to form a dispersion of the particles in the carrier liquid. Means are provided for distributing the particle-containing carrier liquid to conduits for dispensing from the conduits onto the substrate.

Preferably, the housing is formed with the passage substantially tubular to form a substantially tubular flow path, and a plurality of the openings are disposed for introducing a plurality of streams into the passage. The housing may have an annular chamber for receiving the carrier liquid and a plurality of holes communicating between the chamber and the passage for introducing the carrier liquid into the passage, and the housing may have another annular chamber for receiving the other liquid with the aforementioned openings introducing the other liquid from the chamber into the passage. Preferably, there are a plurality of tubes projecting into the passage substantially parallel therewith and the openings are disposed at the ends of the tubes in the passage. In this form the shearing means is disposed at the ends of the tubes for shearing the liquid as it leaves the tubes and enters the passage. Preferably, the shearing means includes wire-like elements rotating in the tubular passage across the openings.

In the preferred embodiment there are a plurality of flow stabilizer elements mounted in the passage and offset from the openings and beyond the shearing means. These stabilizer elements substantially prevent undesirable swirling of the liquid that could otherwise be created by the rotation of the shearing means. Preferably, these flow stabilizer elements are in the form of flat plate-like vanes extending substantially parallel with the flow of carrier liquid in the passage.

In the preferred embodiment, the shearing means is mounted in a space within a body portion of the housing interiorly of the tubular passage and projecting through an annular slot formed in the body portion into the passage for shearing action. Preferably, the body portion is formed with a bore for introducing the carrier liquid into the space within the body portion to occupy the space and prevent the other liquid from entering the space through the slot. This feature allows the space to be occupied by a clear carrier liquid rather than the application liquid so that disassembly and thorough cleaning is not necessary when a different application liquid is to be used in a subsequent operation.

Preferably, the apparatus includes means for disturbing the flow of the particle-containing carier liquid between the housing and the distributing means. This disturbing means disrupts the formation of a pattern of uneven particle distribution in the flow. In the preferred embodiment the disturbing means includes an offset conduit portion through which the particle-containing carrier liquid flows, and means for rotating the offset conduit portion so that any particle pattern of flow or concentration is disrupted and is not likely to continue through the distributing means and onto the substrate.

Preferably, the apparatus includes means for reciprocating the dispensing ends of the conduits with a primary reciprocal motion and a secondary reciprocal motion imposed on the primary motion. This is accomplished in the preferred embodiment by the reciprocating means having a shaft, means for orbiting the shaft about an axis spaced from the shaft, and a first sprocket fixed on the orbiting shaft. A link has one end connected to the orbiting shaft and its other end connected to one portion of a rotatable eccentric shaft on which a second sprocket is fixed. A chain is trained around the sprockets to transmit orbiting of the first sprocket into rotation of the second sprocket and eccentric shaft. The eccentric shaft has a second portion eccentric with the one portion and is rotatably connected to a reciprocably mounted support for the dispensing ends of the conduits for reciprocation of the support by the orbiting of the orbiting shaft through the link and by eccentric rotation of the eccentric shaft. In the preferred embodiment the second sprocket is larger than the first sprocket to produce reciprocation of the conduit support by orbiting of the orbiting shaft at a greater frequency than the reciprocation by rotation of the eccentric shaft. Thus, the sequential reversals of reciprocation of the conduit support will occur at different locations and, thereby, avoid creation of a concentration or pattern effect.

In the preferred embodiment there are plurality of housings in which particles are generated and dispersed in carrier liquids, and means are provided for combining the flow of the particle-containing carrier liquids into a common flow to the distributing means. Preferably, the combining means includes a cylindrical manifold chamber with conduits to which flow from each of the housings is connected tangentially. A common flow conduit extends axially from the cylindrical manifold chamber to conduct the common flow to the distribution means.

DETAILED DESCRIPTION OF THE PREFERRED EMBODIMENT OF THE PRESENT INVENTION

Figure 1:
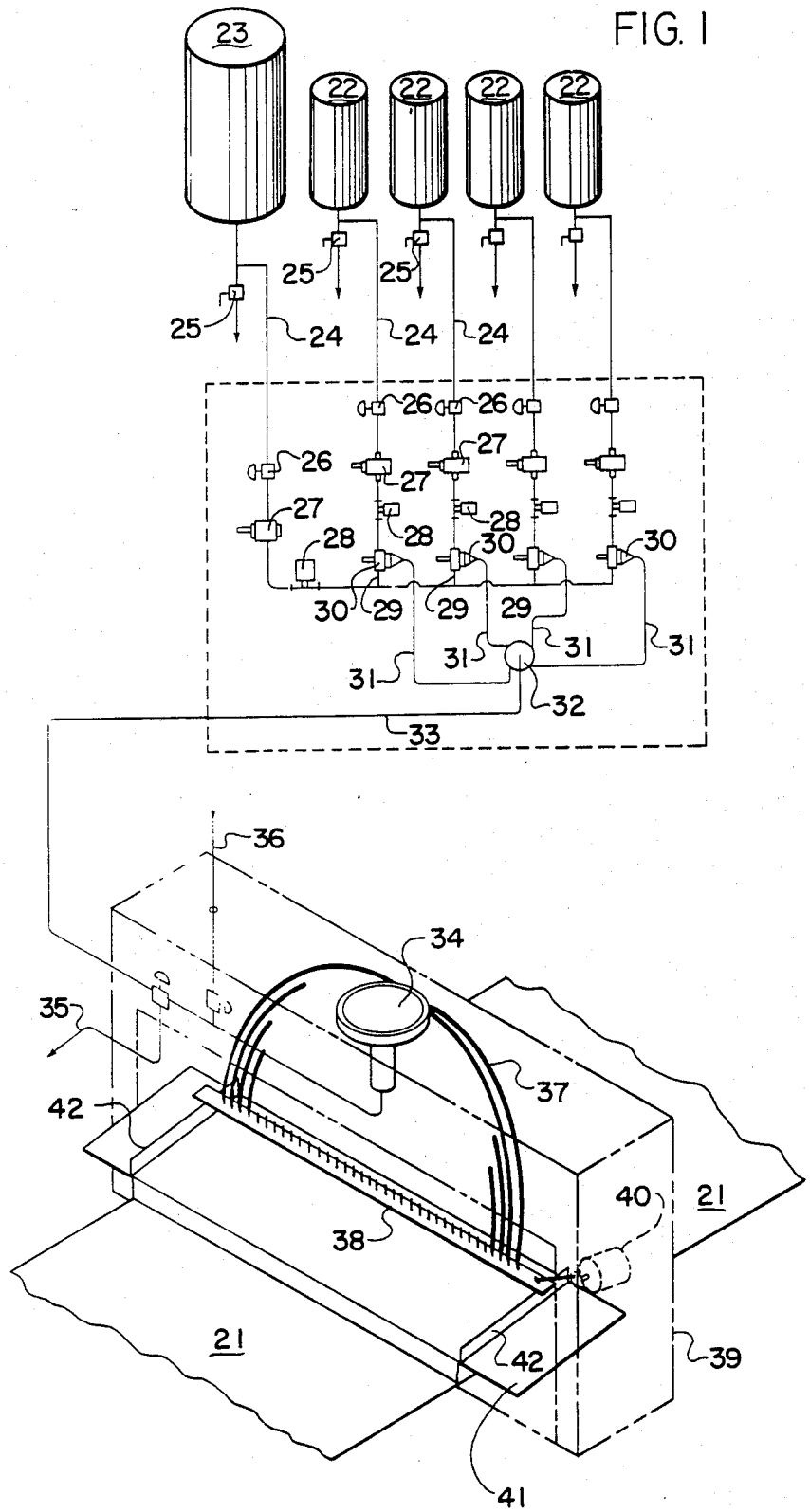
FIG. 1 is a schematic illustration of the preferred embodiment of the apparatus for generating and dispersing immiscible liquid particles in a carrier liquid and dispensing the carrier liquid.
Figure 5:
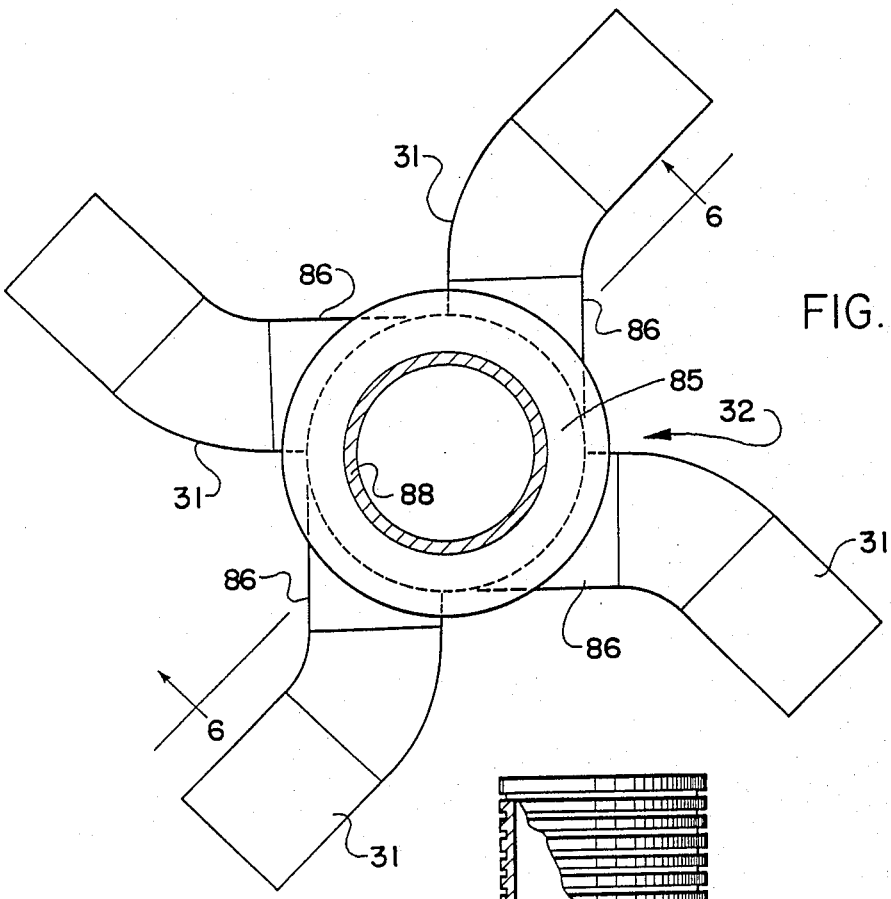
FIG. 5 is a plan view of the combining device of the apparatus of FIG. 1.
Figure 6:
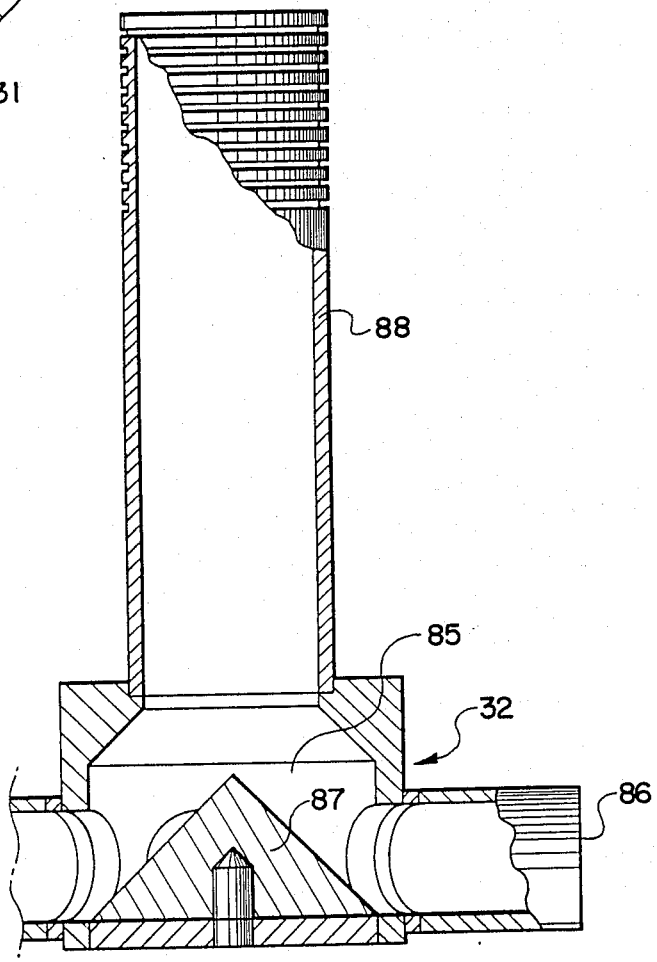
FIG. 6 is a vertical sectional view taken along line 6-6 of FIG. 5.

Referring first to FIG. 1, the apparatus 20 of the preferred embodiment of the present invention is illustrated schematically. The apparatus is in a form adapted for applying dye in particle form to a traveling carpet substrate 21 in a multi-color, randomly speckled effect. The dye is in the form of an anionic dye gum material contained in a plurality of supply containers 22 for dispersion in a cationic clear carrier gum contained in a supply container 23. Supply conduits 24 lead from each container 22, 23 and include drains 25, on-off valves 26, pumps 27 and flow meters 28. Branch conduits 29 lead from the clear gum supply conduits to particle generating and dispersing devices 30 connected in each of the supply conduits for the dye gum. From the particle generating and dispersing devices 30, conduits 31 direct the flow of particle-containing carrier gum liquid to a combining device 32 (FIGS. 5 and 6) in which the flows are mingled into a common flow that is directed through a main conduit 33 to a distributing device 34. The main conduit has connected in it a drain 35 and a flush line 36 for flushing the distributing device 34 with water for cleaning.

The distributing device 34 distributes the flow of particle-containing gum carrier into a plurality of dispensing conduits 37 that have their ends mounted in a reciprocable support 38 mounted in a frame 39 in which the distributing device 34 is also mounted. The conduit support is reciprocated by a reciprocating mechanism 40 also mounted in the frame 39. The particle-containing carrier gum liquid is dispensed from the conduit ends onto an inclined plate 41 from which the material flows onto the traveling substrate 21 therebelow. The material is confined laterally by vertical plate-like dams 42 projecting vertically from the inclined plate 41.

Figure 2:
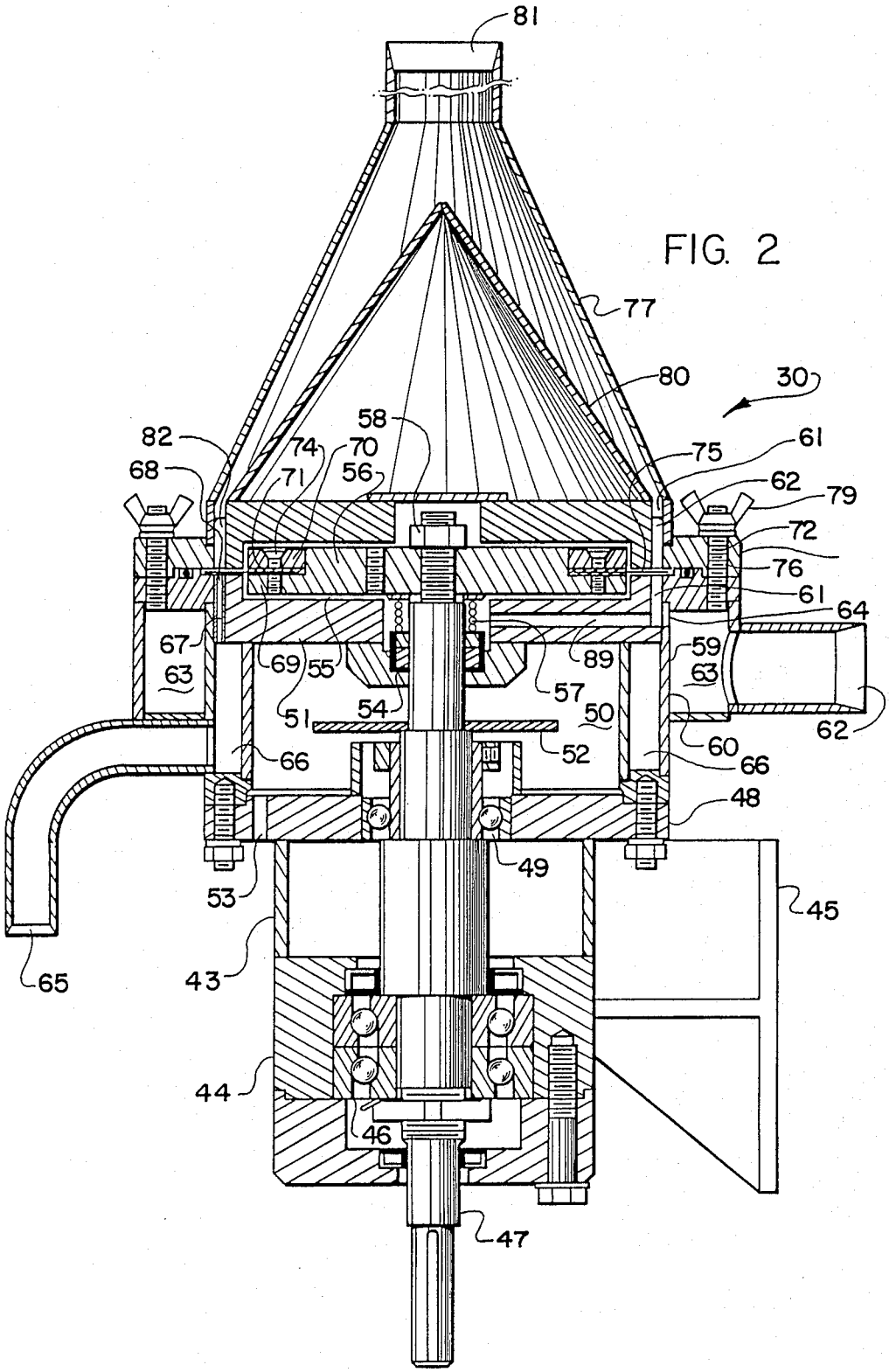
FIG. 2 is a vertical sectional view of the particle generating and dispersing device of the apparatus of the preferred embodiment of the present invention.
Figure 3:
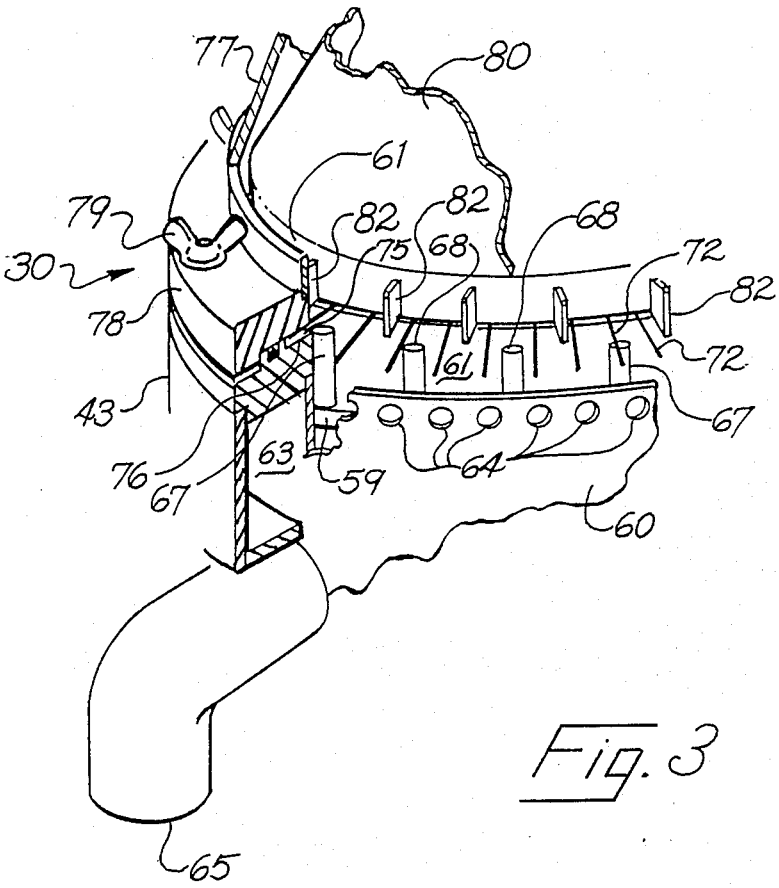
FIG. 3 is a perspective view, partially broken away, of the particle generating and dispersing device of FIG. 2.
Figure 4:
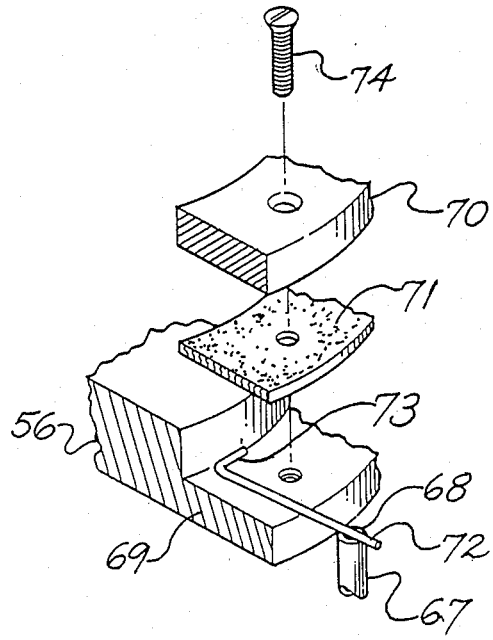
FIG. 4 is an exploded partial view of the shearing means of the device of FIG. 2.

The particle generating and dispersing devices 30 are illustrated in detail in FIGS. 2, 3 and 4. Each consists of a housing 43 having a base 44 mounted on a bracket 45 connected to a main frame (not shown). A bearing 46 is mounted in the base 44 for rotatably supporting a drive shaft 47 that projects below the base 44 for driven connection to a drive motor (not shown). The drive shaft 47 extends vertically within the interior of the housing 43 through an intermediate section 48 that carries a second bearing 49 for support of the drive shaft 47. The drive shaft 47 extends from the bearing 49 through a cavity 50 into an interior body portion 51 thereabove. A splash guard disk 52 of rubber or similar material is mounted on the drive shaft 47 above the second bearing 49 to divert any liquid material escaping into the cavity 50 away from the second bearing 49 for flow through a drain opening 53 in the intermediate section 48 outwardly of the base 44.

The interior body portion 51 carries a seal 54 around the drive shaft 47 and is formed with an open space 55 above the seal and interiorly of the body portion. Threaded on the drive shaft 47 in the space 55 is a rotor 56 of a shearing means. This rotor is fixed on the shaft by a lock nut 58. A spring 57 acts between the seal 54 and rotor 56 to maintain the seal in position. The body portion 51 is formed with an annular flange 59 at its lower outer periphery, which flange 59 is secured to an annular wall 60 of the housing 43. Above the annular flange 59 the body portion is annularly recessed to provide an annular passage 61.

A carrier gum liquid inlet 62 opens into an annular supply chamber 63 through which carrier gum liquid is distributed exteriorly of the annular wall 60, which has a plurality of holes 64 opening from the chamber 63 into the passage 61 for flow of carrier gum liquid into and through the passage 61 in a tubular flow path.

A dye gum inlet 65 opens into a second annular supply chamber 66 that is interiorly of the carrier gum annular chamber 63 and separated therefrom by the annular wall 60. This second annular chamber 66 extends to the underside of the annular flange 59 of the body portion 51. This flange 59 is drilled vertically to seat a plurality of tubes 67 that are open at the second annular chamber 66 and extend upwardly into the passage 61 to provide openings 68 from which the dye gum liquid exits in streams into and parallel with the flow of carrier liquid in the passage 61. The tubes 67 are spaced apart with the holes 64 in the annular wall 60 located in the spaces between tubes so that the carrier gum liquid flows into the passage 61 between the tubes and upwardly through the passage.

The shearing means includes the aforementioned rotor 56, which is mounted on and rotated by the drive shaft 47. The rotor 56 has an outer annular flange 69 on which a retaining ring 70 is fixed. This ring 70 retains a resilient flat annular disk 71 in clamping relation against the flange 69 to secure wire-like shearing elements 72 that project radially from the rotor 56 and have inner bent ends 73 that prevent movement of the shearing elements 72 when the retaining ring 70 is clamped in place by screws 74.

The shearing elements 72 project radially outwardly through the space 55 and a peripheral annular slot 75 in the body portion 51 transverse to the direction of flow of the carrier gum liquid through the passage 61. The shearing elements 72 extend fully across the tubular passage 61 into an annular recess 76 in the housing 43 at the outer periphery of the passage 61. The aforementioned tubes 67 are arranged with their openings 68 immediately adjacent the shearing elements 72 so that as the streams of dye gum liquid enter the passage 61 from the openings 68 they are immediately sheared into discrete particles that are dispersed into the flow of the carrier gum liquid. This shearing action of the wire-like elements 72 adjacent the openings 68 shears the material sharply and substantially avoids the formation of tails or other less finite particle formations. The shearing means could include forms other than wire-like elements. For example, a disc with holes or slots located above the tubes could be used.

Above the annular recess 76 for the shearing elements 72, the housing 43 is formed with a conical upper section that has a flange 78 secured by thumbscrews 79 to the remainder of the housing 43. Similarly, the body portion 51 is formed with an upper conical section 80 that has a greater inclination than the outer conical section 77 so that the passage 61 therebetween is of substantially constant cross sectional area for uniform flow of the particle-containing carrier gum liquid through the passage 61 to an outlet 81.

Mounted in the passage 61 are a plurality of stabilizing elements 82 in the form of flat plate-like vanes parallel to the flow of particle-containing carrier gum liquid. These stabilizing elements 82 are offset from the tubes 67 so that the streams of dye gum liquid enter between the elements 82. These elements 82 stabilize the tubular flow of the liquid against the tendency of swirling or rotation that would otherwise be caused by the rotation of the shearing elements 72 transverse to the flow of liquid. The stabilizing elements 82 have their outer edges secured to the interior of the upper conical section 77 of the housing 43 and their inner edges connected to the upper conical section 80 of the body portion 51 so that they support the upper conical section 80 of the body portion in place above the slot 75 and interior space 55 of the body portion 51.

The body portion 51 is further formed with a pair of bores 83 extending radially from the passage 61 interiorly of the holes 64 into the space 55 in which the shearing means rotor 56 is mounted. These bores 83 serve to allow the carrier gum liquid to pass therethrough into the space 55 and through the slot 75, thereby preventing entry of the dye gum liquid into the space. This allows the device to be changed from one dye to another without having to disassemble the parts as the interior is occupied by the clear carrier gum liquid, not the dye gum liquid.

In operation of the particle generating and dispersing devices, carrier gum liquid enters the inlet 62 and passes through the annular chamber 63 and holes 64 into the passage 61. Simultaneously, the dye gum liquid enters the inlet 65 and passes through the second annular chamber 66 and through the tubes 67 into the passage 61 in streams parallel to the tubular flow of the carrier gum liquid. The dye gum is immediately sheared as it leaves the tubes 67 into discrete particles by the rotating shearing elements 72 which particles are thereby dispersed in the carrier gum liquid and carried therewith past the stabilizing elements 82 and through the passage 61 to the outlet 81.

From the outlet 81 of each of the particle generating and dispersing devices 30, the particle carrier gum liquid travels through the conduits 31 to the aforementioned combining device 32 (illustrated in FIGS. 5 and 6), which includes a cylindrical manifold portion 85 having tangentially arranged inlets 86 to which the conduits are attached for delivering the flows of particle-containing carrier gum liquid tangentially into the manifold 85 for blending therein with the assistance of a conical projection 87 that tends to direct the blended liquid in a common flow through a common conduit 88 to the aforementioned main conduit 33 that is secured to the end of the common conduit 88.

Figure 7:
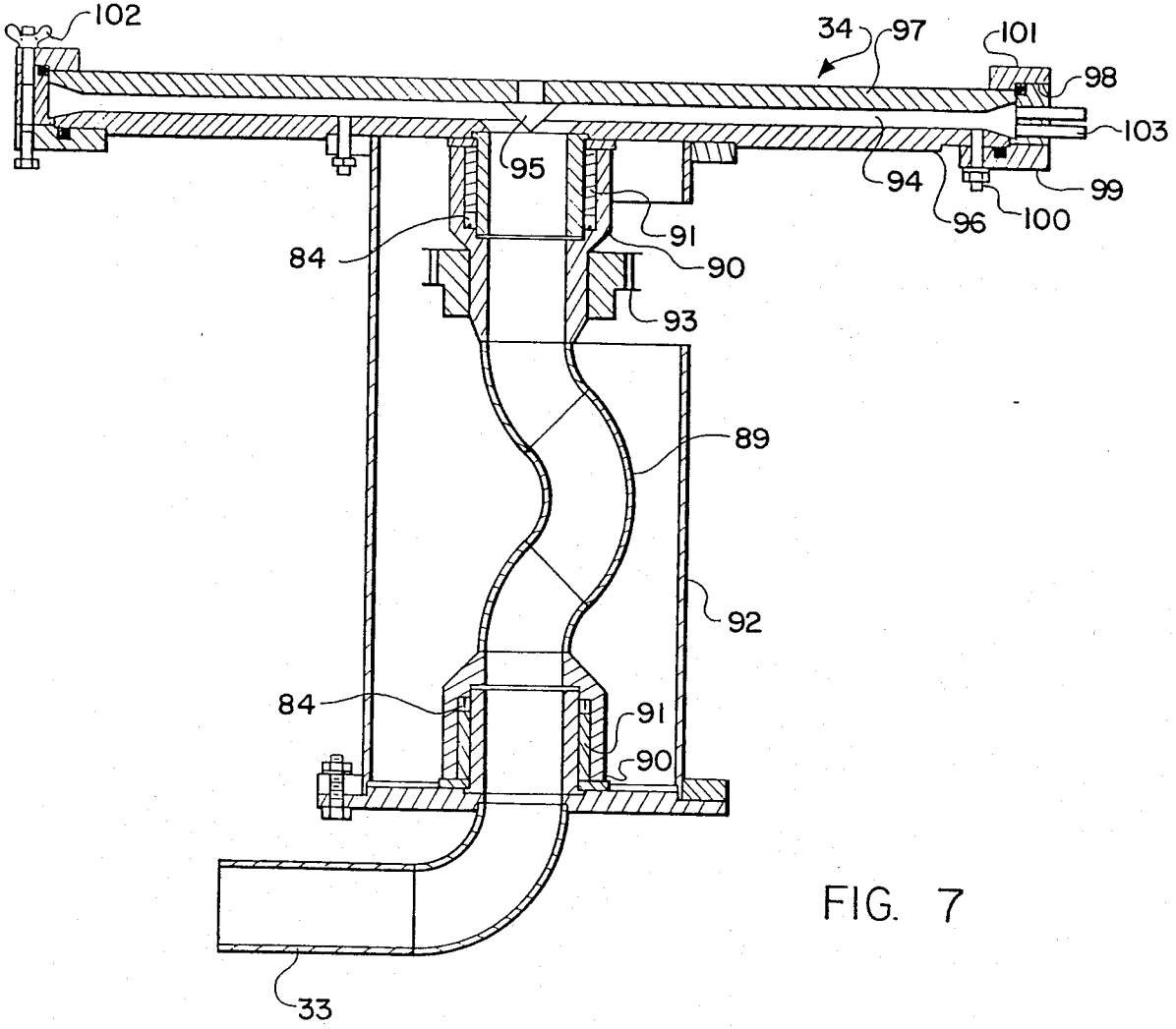
FIG. 7 is a vertical sectional view of the flow disturbing means and the distributor means of the apparatus of FIG. 1.

The main conduit 33 carries the flow of liquid to the aforementioned distributing device 34 illustrated in FIG. 7. As the flow passes to the distributing device 34, it first passes through means for disturbing the flow. When particle-containing liquid flows through conduits, particularly in an asymmetric conduit layout, there is a tendency for uneven concentration of the particles in the flow, which could result in an uneven concentration of particles being distributed by the distribution means and a non-uniformity of particle distribution to the conduits from which the liquid is dispensed for application to the carpet. The present flow disturbing means counters such tendency of particle concentration, and for which purpose it is in the form of an offset conduit portion 89 having its opposite ends 90 mounted in bearings 91 in the frame 92 of the distributing device 34 with cup seals 84 between the offset conduit 89 and adjacent components. A sprocket 93 is fixed to the offset conduit portion 89 and a chain drive (not shown) is attached to the sprocket 93 to cause rotation of the offset conduit portion 89, thereby disturbing the flow and preventing the formation of particle concentration patterns that could otherwise develop and be carried to the ultimate application to the substrate. This flow distrubing means could alternatively be in the form of a rotating straight pipe section, a stationary mixer, a vibrator, an exciter or other suitable device.

The offset conduit portion 89 opens into a thin cylindrical chamber 94 at the axis thereof against a conical diverter 95. The chamber 94 is formed by a lower circular plate that has an axial opening for flow of the liquid from the offset conduit portion 89 into the chamber 94. A top plate 97 is spaced from the lower plate 96 by a peripheral ring 98 that has a lower flange 99 secured by a bolt and nut 100 to lower plate 96 and to a projecting annular flange 101 on the top plate 97. These parts are retained together by a plurality of lock nuts and bolts 102. Projecting radially from the annular ring 98 are a plurality of tubes 103 arranged in pairs and from which the uniformly distributed particle-containing carrier gum liquid is discharged by the distributing device 34 to the aforementioned dispensing conduits 37.

Figure 8:
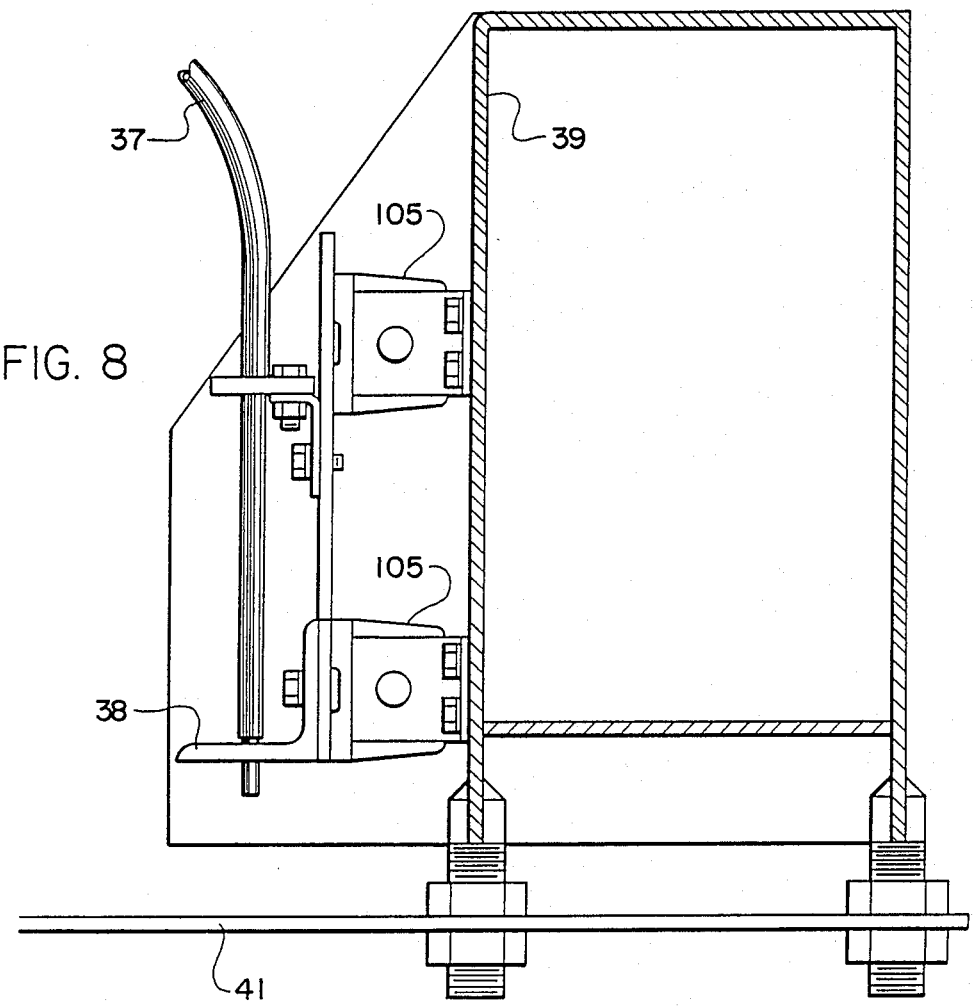
FIG. 8 is a vertical sectional view of the reciprocable conduit support of the apparatus of FIG. 1.

The dispensing conduits 37 extend to a location adjacent the aforementioned inclined plate 41, above which the ends 104 of the dispensing conduits 37 are mounted in the aforementioned support 38 with the ends pointing downwardly for discharge of the particle-containing carrier liquid onto the inclined plate 41. The support is in the form of an elongated plate-like member that extends transversely across the traveling width of the carpet and is mounted for transverse reciprocal motion in pairs of spaced slide bearings 105 mounted on the frame 39 as illustrated in FIG. 8, and reciprocated by the aforementioned reciprocating mechanism 40. The housing 39 is raisable to open the apparatus and is pivotable for inclination of the plane 41 to adjust the flow of liquid thereon.

Figure 11:
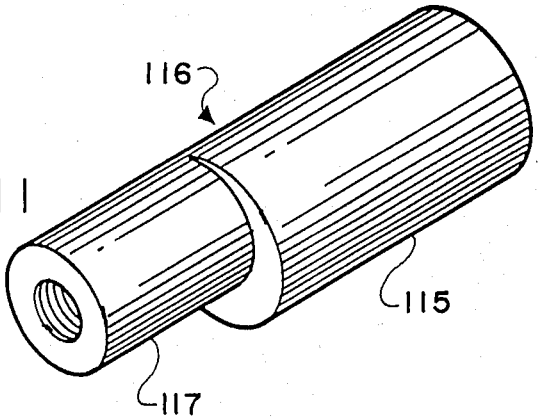
FIG. 11 is a perspective view of the eccentric shaft included in the oscillating mechanism of FIGS. 9 and 10.
Figure 9:
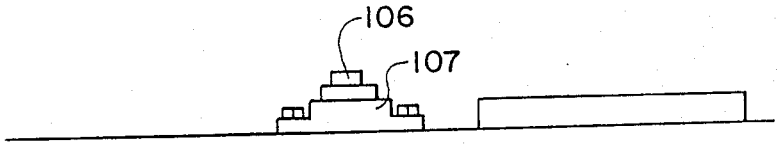
FIG. 9 is a plan view of the mechanism for oscillating the conduit support in the apparatus of FIG. 1.
Figure 9:
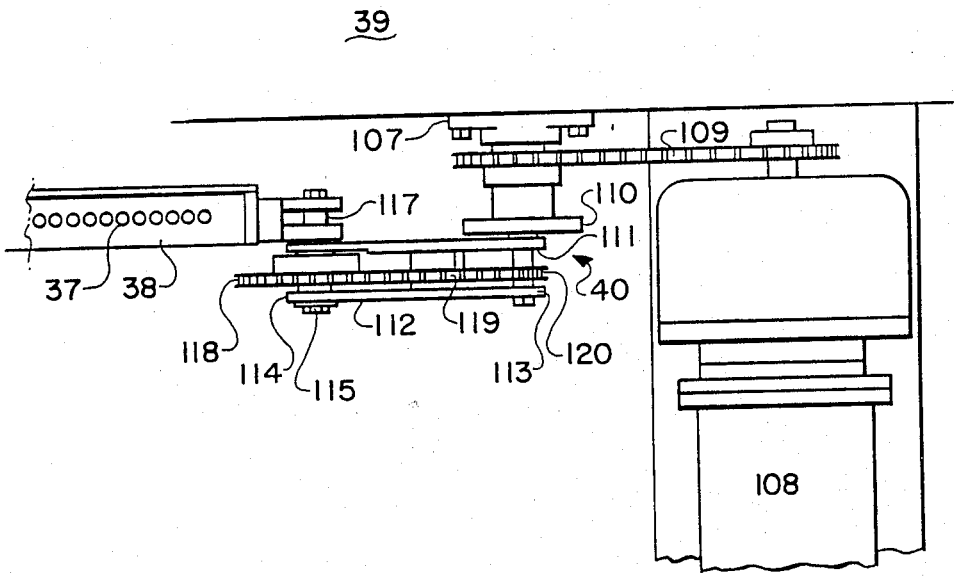
Figure 10:
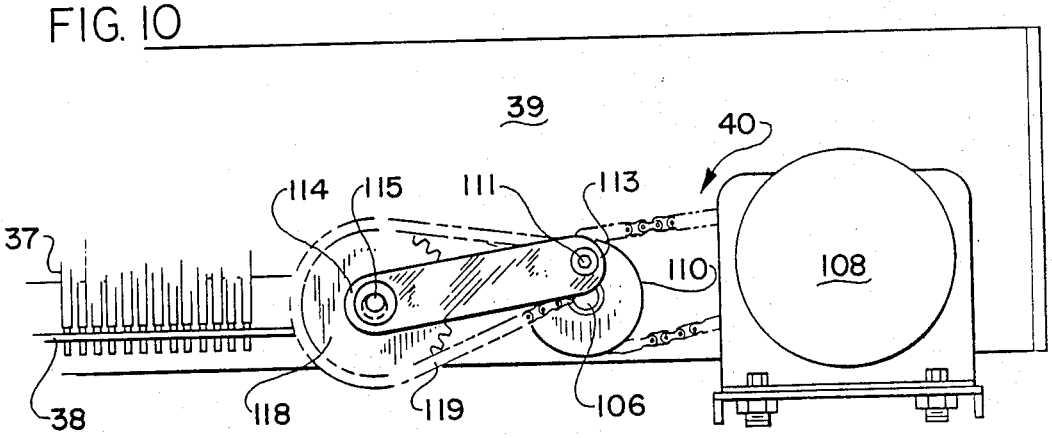
FIG. 10 is an elevation of the oscillating mechanism of FIG. 9.

The reciprocating mechanism 40 illustrated in FIGS. 9, 10 and 11 includes a main drive shaft 106 rotatably mounted in the frame 40 in bearings 107 for extension transverse to the extent of the support 38. This main drive shaft 106 is rotated by a drive motor 108 through a chain and sprocket drive connection 109. The main drive shaft 106 carries a rotating plate 110 on which a shaft 111 projects in fixed relation at a spacing from the axis of the main drive shaft 106, which is the axis of rotation of the plate 110 and projecting shaft 111. Thus, the shaft 111 moves in an orbiting manner about the axis of the main drive shaft. A link 112 has one end 113 connected to the orbiting shaft 111 and has its other end 114 connected to one portion 115 of a rotatable eccentric shaft 116 that is rotatably mounted on the support 38. Through this connection the orbiting shaft 111 imparts through the link 112 a primary reciprocal motion to the support 38 and dispensing ends 104 of the conduits 37.

As illustrated in FIG. 11, the eccentric shaft 116 has the one portion 115 to which the end 114 of the link 112 is connected and also has another portion 117 having its axis offset from the one portion 115 and mounted for rotation on the support 38. Mounted on the one portion 115 is a sprocket 118 around which a chain 119 is trained and also trained around a sprocket 120 on the orbiting shaft 111. With this chain connection, as the orbiting shaft 111 orbits, the sprocket 120 follows the orbiting circular path, resulting in relative rotation with respect to the chain 119 to cause the chain to advance equivalent to one rotation of the sprocket for each orbit of the orbiting shaft 111. The chain in turn causes the sprocket 118 on the eccentric shaft 116 to rotate, thereby rotating the eccentric shaft 116 and creating secondary reciprocal motion of the support 38 through the mounting of the other portion 117 of the eccentric shaft 116 on the support 38.

The first sprocket in driving sequence, which is the sprocket 120 mounted on the orbiting shaft 111, is related in size to the second sprocket, which is the sprocket 118 mounted on the eccentric shaft 116, such that the frequency of the primary reciprocal motion created by orbiting of the orbiting shaft 111 is at a greater frequency than the secondary reciprocal motion imparted by rotation of the eccentric shaft 116. To accomplish this, the second sprocket 120 is larger than the first sprocket 118. In the preferred embodiment, the second sprocket 118 has four times as many teeth as the first sprocket 120 so that the frequency of the primary reciprocal motion is four times the frequency of the secondary reciprocal motion. Thus, during each four sequential reciprocations of the support 38 by the orbiting shaft 111, the rotating eccentric shaft 116 will impose four smaller sequential increments of reciprocal motion that will result in the end of the stroke of the reciprocating support 38 being at four different locations, thus avoiding the creation of a pattern or concentration of particles that may otherwise occur if the reversal of the stroke of reciprocation were at the same place on every stroke. In place of the chain connection, the link could incorporate a ratchet mechanism for rotating the eccentric shaft.

The described preferred embodiment of the present invention is particularly applicable for generating and dispersing particles of commercially available gum compositions conventionally used to contain dye for dyeing carpet and with carrier gums conventionally used with such dye-containing gum. However, the invention is applicable as well with liquids that are at least temporarily immiscible so that the particles can be generated and carried discretely to an application before the particle liquid becomes dissolved in the carrier liquid. Various other liquids could be used, such as colored oils and water. Also, the invention is applicable to use with substrates other than carpet or textiles and the various features described have applications separately, not only in combination.

In the preferred embodiment, the particle generating and dispersing means is arranged with 32 holes 64 formed in the annular wall 60 for introduction of the carrier gum liquid into the tubular passage 61. There are 16 tubes 67 projecting into the passage 61 for introduction of the dye gum liquid through the opening 68, with the tubes 67 located in alternate spaces between the holes 64. There are also 16 stabilizing elements 82 located between tubes and in the space between holes 64 alternating with the spaces in which the tubes are located. There are 32 wire-like elements of 0.05 inches diameter in the shearing means and they rotate in a plane as close as possible to the openings 62, preferably within a few thousandths of an inch to assure abrupt generation of particles without tailing. The shearing means rotates the wire-like shearing elements at a rate of 500 to 600 revolutions per minute. The dye gum liquid is pumped through each particle generating and dispersing device at a typical range of 50 cubic centimeters per minute to 2 liters per minute, preferably approximately 200 cubic centimeters per minute, and the carrier gum is pumped through all of the particle generating and dispersing devices at a combined total rate of typically 50 liters per minute to 150 liters per minute and preferably approximately 70 liters per minute. There are 360 tubes 103 around the periphery of the distributing means 34 with a like number of dispensing conduits 37 having their dispensing ends mounted in the support 38 at typical spacings of one-half inch on centers. The tubes at the opposite ends of the support 38 may be blocked off to prevent flow beyond the edges of carpets of different widths. The stroke of the primary reciprocal motion is typically adjustable to three and one-half inches and the stroke of the secondary reciprocal motion is typically approximately one-quarter inch. Typical carrier gums used are highly thixotropic and have a viscosity in the range of 500–2,000 cps, typically approximately 1,000 cps, and typical dye gums are also highly thixotropic and have a viscosity in the range of 1,000 to 3,000 cps, typically approximately 3,000 cps.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, said opening being disposed for introducing said stream in a path substantially parallel to said flow path, said shearing means shearing said stream substantially transverse to said flow path, said passage being substantially tubular to form a substantially tubular flow path and a plurality of said openings being disposed for introducing a plurality of said streams, said housing having an annular chamber for receiving said carrier liquid and having a plurality of holes communicating between said chamber and said passage for introducing said carrier liquid into said passage, said housing having another annular chamber for receiving said another liquid, and said openings being disposed to introduce said another liquid from said another chamber into said passage.

2. An apparatus for generating and dispersing liquid particles in a carrier liquid and dispensing said carrier liquid according to claim 1 characterized further by a plurality of tubes projecting into said passage substantially parallel therewith and having said openings at their ends in said passage, and said shearing means being disposed at said ends of said tubes.

3. An apparatus for generating and dispersing liquid particles in a carrier liquid and dispensing said carrier liquid according to claim 1 and characterized further by a plurality of flow stabilizer elements mounted in said passage offset from said openings and beyond said shearing means.

4. An apparatus for generating and dispersing liquid particles in a carrier liquid and dispensing said carrier liquid according to claim 3 and characterized further in that said stabilizer elements are in the form of flat plate-like vanes extending substantially parallel with said flow.

5. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits, means for distributing said particle containing carrier liquid to said conduits for dispensing from said conduits onto a substrate, said opening being disposed for introducing said stream in a path substantially parallel to said flow path, said shearing means shearing said stream substantially transverse to said flow path, said passage being substantially tubular to form a substantially tubular flow path and a plurality of said openings being disposed for introducing a plurality of said streams, a plurality of tubes projecting into said passage substantially parallel therewith and having said openings at their ends in said passage, and said shearing means being disposed at said ends of said tubes.

6. An apparatus for generating and dispersing liquid particles in a carrier liquid and dispensing said carrier liquid according to claim 5 and characterized further in that said shearing means includes wire-like elements rotating in said tubular passage across said openings.

7. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, said opening being disposed for introducing said stream in a path substantially parallel to said flow path, said shearing means shearing said stream substantially transverse to said flow path, said passage being substantially tubular to form a substantially tubular flow path and a plurality of said openings being disposed for introducing a plurality of said streams, said shearing means includes wire-like elements rotating in said tubular passage across said openings.

8. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, said opening being disposed for introducing said stream in a path substantially parallel to said flow path, said shearing means shearing said stream substantially transverse to said flow path, said passage being substantially tubular to form a substantially tubular flow path and a plurality of said openings being disposed for introducing a plurality of said streams, said housing having a body portion interiorly of said tubular passage with a space formed therein and an annular slot extending between said space and said passage, said shearing means being mounted in said space and projecting through said slot into said passage.

9. An apparatus for generating and dispersing liquid particles in a carrier liquid and dispensing said carrier liquid according to claim 8 and characterized further in that said body portion is formed with a bore for introducing said carrier liquid into said space to occupy said space and prevent said another liquid from entering said space through said slot.

10. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, means disposed between said housing and said distributing means for disturbing the flow of said particle containing carrier liquid to disrupt the formation of a pattern of uneven particle distribution in said flow, said flow disturbing means including an offset conduit portion for said flow and means for rotating said offset conduit portion.

11. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, means for reciprocating the dispensing ends of said conduits with a primary reciprocal motion and a secondary reciprocal motion imposed on said primary reciprocal motion.

12. An apparatus for generating and dispersing liquid particles in a carrier liquid and dispensing said carrier liquid according to claim 11 and characterized further in that said reciprocating means comprises a shaft, means for orbiting said shaft about an axis spaced from said shaft, a first sprocket fixed on said orbiting shaft, a link having one end connected to said orbiting shaft, a rotatable eccentric shaft having one portion connected to the other end of said link, a second sprocket fixed on said one portion, a chain trained around said sprockets to transmit orbiting of said first sprocket into rotation of said second sprocket and eccentric shaft, said eccentric shaft having a second portion eccentric with said one portion, a reciprocably mounted support for said dispensing ends of said plurality of conduits, said second portion of said eccentric shaft being rotatably connected to said support for reciprocation thereof by the orbiting of said orbiting shaft through said link and by eccentric rotation of said eccentric shaft.

13. An apparatus for generating and dispersing liquid particles in a carrier liquid and dispensing said carrier liquid according to claim 12 characterized further in that said second sprocket is larger than said first sprocket to produce reciprocation of said conduit support by orbiting of said orbiting shaft at a greater frequency than the reciprocation by rotation of said eccentric shaft.

14. An apparatus for generating and dispersing liquid particles in a carrier liquid and dispensing said carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, a plurality of dispensing conduits, means for distributing said particle containing carrier liquid to said conduits for dispensing from said conduits onto a substrate, a plurality of means for providing supplies of other liquids that are at least temporarily immiscible in said carrier liquid, a plurality of said housings for receiving other liquids from said supplies, and means for combining the flow of particle-containing carrier liquids into a common flow for flow to said distributing means.

15. An apparatus for generating and dispersing liquid particles in a carrier liquid and dispensing said carrier liquid according to claim 14 and characterized further in that said combining means comprises a cylindrical manifold chamber, conduits for flow from each of said housings connected to said manifold chamber tangentially, and a common flow conduit extending axially from said cylindrical manifold chamber to said distribution means.

16. An apparatus for generating and dispersing liquid particles in a carrier liquid and dispensing said carrier liquid according to claim 14 and characterized further by means disposed between said combining means and said distributing means for disturbing the flow of said particle containing carrier liquid to disrupt the formation of a pattern of uneven particle distribution in said flow.

17. An apparatus for generating and dispersing liquid particles in a carrier liquid and dispensing said carrier liquid according to claim 16 and characterized further in that said flow disturbing means includes an offset conduit portion for said flow and means for rotating said offset conduit portion.

18. An apparatus for generating and dispersing liquid particles in a carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, said openings being disposed for introducing said stream in a path substantially parallel to said flow path, said shearing means shearing said stream substantially transverse to said flow path, said passage being substantially tubular to form a substantially tubular flow path, a plurality of said openings being disposed for introducing a plurality of said streams, said housing having an annular chamber for receiving said carrier liquid and having a plurality of holes communicating between said chamber and said passage for introducing said carrier liquid into said passage, said housing having another annular chamber for receiving said another liquid, and said openings being disposed to introduce said another liquid from said another chamber into said passage.

19. An apparatus for generating and dispersing liquid particles in a carrier liquid according to claim 18 and characterized further by a plurality of tubes projecting into said passage substantially parallel therewith and having said openings at their ends in said passage, and said shearing means being disposed at said ends of said tubes.

20. An apparatus for generating and dispersing liquid particles in a carrier liquid according to claim 18 and characterized further by means for disturbing the flow of said particle containing liquid to disrupt the formation of a pattern of uneven particle distribution in said flow.

21. An apparatus for generating and dispersing liquid particles in a carrier liquid according to claim 20 and characterized further in that said flow disturbing means includes an offset conduit portion for said flow and means for rotating said offset conduit portion.

22. An apparatus for generating and dispersing liquid particles in a carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, said openings being disposed for introducing said stream in a path substantially parallel to said flow path, said shearing means shearing said stream substantially transverse to said flow path, said passage being substantially tubular to form a substantially tubular flow path, a plurality of said openings being disposed for introducing a plurality of said streams, a plurality of tubes projecting into said passage substantially parallel therewith and having said openings at their ends in said passage, and said shearing means being disposed at said ends of said tubes.

23. An apparatus for generating and dispersing liquid particles in a carrier liquid according to claim 22 and characterized further in that said shearing means includes wire-like elements rotating in said tubular passage across said openings.

24. An apparatus for generating and dispersing liquid particles in a carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, said openings being disposed for introducing said stream in a path substantially parallel to said flow path, said shearing means shearing said stream substantially transverse to said flow path, said passage being substantially tubular to form a substantially tubular flow path, a plurality of said openings being disposed for introducing a plurality of said streams, said shearing means including wire-like elements rotating in said tubular passage across said openings.

25. An apparatus for generating and dispersing liquid particles in a carrier liquid, said apparatus comprising means for providing a supply of a carrier liquid, means for providing a supply of another liquid that is at least temporarily immiscible in said carrier liquid, a housing adapted to receive liquid from said supplies, said housing having a passage for flow of carrier liquid in a flow path therethrough, said housing having an opening for introducing a stream of said another liquid into said flow path in said passage, shearing means mounted in said housing and extending into said flow path in said passage at said stream for shearing said stream into discrete particles to form a dispersion of said particles in said carrier liquid, said openings being disposed for introducing said stream in a path substantially parallel to said flow path, said shearing means shearing said stream substantially transverse to said flow path, said passage being substantially tubular to form a substantially tubular flow path, a plurality of said openings being disposed for introducing a plurality of said streams, said housing having a body portion interiorly of said tubular passage with a space formed therein and an annular slot extending between said space and said passage, said shearing means being mounted in said space and projecting through said slot into said passage.

26. An apparatus for generating and dispersing liquid particles in a carrier liquid according to claim 25 and characterized further in that said body portion is formed with a bore for introducing said carrier liquid into said space to occupy said space and prevent said another liquid from entering said space through said slot.

* * * * *

UNITED STATES PATENT AND TRADEMARK OFFICE

CERTIFICATE OF CORRECTION

PATENT NO. : 4,884,893

DATED : December 5, 1989

INVENTOR(S) : Dieter F. Zeiffer and George Michael Junkins

It is certified that error appears in the above-identified patent and that said Letters Patent is hereby corrected as shown below:

Column 2, Line 1, after "liquid is" add -- dispensed for application to a substrate. Preferably, the flow path of the carrier liquid is --.

Column 6, Line 64, after "conduits" add -- 31 --.

Column 7, Line 27, delete "distrubing" and insert therefor -- disturbing --.

Column 9, Line 8, delete "16" (in boldface type) and insert therefor -- 16 -- (in non-boldface type).

Column 10, Line 42, delete "said stabilizer" and insert therefor -- said flow stabilizer --.

Column 10, Lines 60-62, after "to said conduits" delete -- , means for distributing said particle containing carrier liquid to said conduits --.

Signed and Sealed this

Ninth Day of June, 1992

*Attest:*

DOUGLAS B. COMER

*Attesting Officer*

*Acting Commissioner of Patents and Trademarks*